US005727615A

United States Patent [19]

Middeldorf et al.

[11] Patent Number: 5,727,615

[45] Date of Patent: Mar. 17, 1998

[54] MOLD ARRAGEMENT

[75] Inventors: Helge Middeldorf, Duisburg; Alfons Krausa, Schermbeck; Jens Weber, Duisburg; Horst Von Wyl, Duisburg; Hans Günter Thurm, Duisburg; Otto Alexander Schmidt, Krefeld; Hans Siemer, Essen; Dietmar Lohse, Wesel, all of Germany

[73] Assignee: Mannesmann Aktiengesellschaft, Duesseldorf, Germany

[21] Appl. No.: 573,441

[22] Filed: Dec. 15, 1995

[30] Foreign Application Priority Data

Mar. 29, 1995 [DE] Germany ..... 195 13 045.6

[51] Int. Cl.[6] ..... B22D 27/02

[52] U.S. Cl. ..... 164/502; 164/504

[58] Field of Search ..... 164/466, 468, 164/502, 504

[56] References Cited

U.S. PATENT DOCUMENTS 5,238,051 8/1993 Kikuchi et al. ..... 164/502
5,332,027 7/1994 Kageyama et al. ..... 164/502

FOREIGN PATENT DOCUMENTS 1-289550 11/1989 Japan ..... 164/504

*Primary Examiner*—Kuang Y. Lin
*Attorney, Agent, or Firm*—Cohen, Pontani, Lieberman, Pavane

[57] ABSTRACT

A mold arrangement for the production of endless castings of metal, particularly slabs of steel, having copper plates for the wide sides of the mold which rest on coolable support plates, and narrow sides which can be clamped between the wide sides. Additionally, an oscillating device is connected with the support plates. The support plates are trough-shaped in the region of the mold wide sides. Channels are provided in the wall of the support plates for the passage of a cooling fluid. Electromagnetic structural parts arranged on mounting frames can be freely introduced into the trough free space which faces away from the wide sides.

12 Claims, 4 Drawing Sheets

MOLD ARRAGEMENT

BACKGROUND OF THE INVENTION

1. Field of the Invention

The present invention relates to an ingot mold arrangement for producing endless castings of metal, in particular slabs of steel having copper plates for the wide sides of the mold, which sides rest on suitable support plates. The mold further having narrow sides which can be clamped between the wide sides, and an oscillating device attached to the support plates.

2. Discussion of the Prior Art

In order to achieve a high quality steel in continuous casting molds for the production of steel castings, electromagnetic agitating or brake devices are used to suitably move the molten steel bath. When agitators are employed, the molten steel bath is suitably moved so that a high proportion of aligned crystallites with sufficient depositing of the inclusions results. With brake devices, Lorentz forces are employed, which produce a high exit velocity from the immersed outlet and thus reduce the height of the surface wave.

For the ingot drives and suspensions different structural forms are used. Thus, from DE 40 23 672 A1 a liquid-cooled mold is known for continuously casting metals in which only the actual crystallizer, and therefore the copper plates with the corresponding support plates, including the displacement device for the narrow sides, are moved by an oscillating device. For suspension of the support plates, spring elements are provided which are fastened to a mounting plate attached to a stationary base frame. The mold arrangement known from this reference does not have an electromagnetic arrangement.

A continuous casting mold with an agitator coil for rectangular castings is known from DE 31 12 930 C2. In this mold four support plates are clamped together and held in an assembled condition by two longitudinal girders that are clamped together by tie bolts. The agitating devices are provided within the assembled support plates.

The structural connection of the support plates and the coil makes it necessary for the agitator coil, or a brake which can optionally also be installed, to be moved by the oscillating device during the operation, which constitutes a disadvantage.

The same is true of the electromagnetic agitating device disclosed in DE 31 06 591 A1. In this agitating device, which is designed for steel continuous casting molds, an agitator winding chamber is arranged at an upper part of the cooling box. In one development of this agitating device, the agitation winding is freely insertable into and removable from the cooling box in one piece with the fastening plate. In this case, the fastening plate serves as a cover for closing the opening of the agitation winding chamber and at the same time forms the rear wall thereof.

With this construction of the agitation chamber, the agitator coil must always be removed in expensive fashion upon a change in the cooling elements, which is a costly procedure.

SUMMARY OF THE INVENTION

Accordingly, it is an object of the present invention to provide a mold arrangement which is of a compact low-distortion construction and is easily replaceable and which, without increasing the mass to be moved by the oscillating device, permits the use of an electromagnetic structural part.

Pursuant to this object, and others which will become apparent hereafter, one aspect of the present invention resides in a mold arrangement having a mold with wide sides made of copper plates and narrow sides which are clamped between the wide sides. The wide sides of the mold rest on coolable support plates which are configured to have a trough-shape in a region of the wide sides. An oscillating device is connected to the support plates to provide oscillation. Coolant channels are arranged in the wall of the support plates to permit the passage of a cooling fluid therethrough. Additionally, electromagnetic components mounted on frames are arranged to be freely introducible into a free space created by the trough-shape support plates.

In accordance with the invention, the support plates have a trough shape. Due to this shape, not only do the support plates which support the copper wide sides of the mold have a high rigidity but, in addition to the suitable guidance of the coolant, a freely usable space is created within which an electromagnetic agitating or braking device can be introduced.

When using a coil, the trough-shape allows the coil to be brought close to the core cross section of the casting to obtain a maximum magnetic penetration. By the arrangement of the agitating device on the mounting frame of the mold arrangement, the masses moved upon the oscillation are not increased.

In addition to this, the invention makes it possible to move the electromagnetic device perpendicular to the direction of conveyance of the casting independent of the oscillating mass of the mold arrangement. In this way it is possible to release the support plates by extremely simple means for removal from the mold arrangement. Furthermore, the plant can be operated as desired, without any further expense, with or without an agitating or braking device.

Furthermore, without influencing the oscillating masses, the electromagnetic device can be moved parallel to the direction of conveyance of the casting in order to obtain an optimum adjustment of the agitating or braking device even during operation.

By incorporating channels in the trough-shaped support plates, a controlled guidance of the coolant, and thus a well-defined removal of heat, can be obtained.

The trough-shaped construction of the support plates is characterized by a particular rigidity. For the further increase of this rigidity, webs or ribs can be introduced into the free space of the trough.

In a further embodiment of the invention the support plates have projections which rest on mounting yokes. This provides the structural advantage that the support plates can be assembled together particularly easily. In this way not only is installation time minimized, but the possibility is also afforded of preassembling the mold by simple means.

Due to the structural detachment of the electromagnetic device from the oscillating part of the mold arrangement, there is furthermore the possibility of easy vertical adjustment since there is free access from the outside. In addition, only one coil or brake per casting is necessary, since they remain in the installation even upon a change of the support plates. In the known arrangements, the removable support plates are in each case to be kept on reserve with an electromagnetic device.

The fastening of the electromagnetic device as an agitator coil is effected in simple fashion by moving the coil core to the bottom of the trough using a drive. The coil which surrounds the coil core is, in this connection, also moved in the direction of the support plate and is stopped shortly in front of the outer edge of the support plate. For dependable positioning, the coil core is clamped in place.

The individual coil cores rest on a common coil yoke. In this connection, the coil yoke is ring-shaped and extends around the support plates.

The projections of the individual support plates are provided at the head end of the plates. The mounting yokes on which the projections rest are configured to surround the narrow-side displacement and so as to be easily removable from the installation, without being hindered in any way, together with the support plate which they bear.

In an advantageous manner, the mounting yokes have water guides for connecting a water feed or discharge with the support plates. In this connection, elastic elements are provided between the support plates and the mounting yokes to permit a horizontal displacement of the wide sides with respect to each other without interfering with the guidance of the water.

Furthermore, the mounting yokes are configured so that they hold the support plates and permit their horizontal attachment to each other.

The various features of novelty which characterize the invention are pointed out with particularity in the claims annexed to and forming a part of the disclosure. For a better understanding of the invention, its operating advantages, and specific objects attained by its use, reference should be had to the drawing and descriptive matter in which there are illustrated and described preferred embodiments of the invention.

DETAILED DESCRIPTION OF THE PREFERRED EMBODIMENTS

Figure 1:
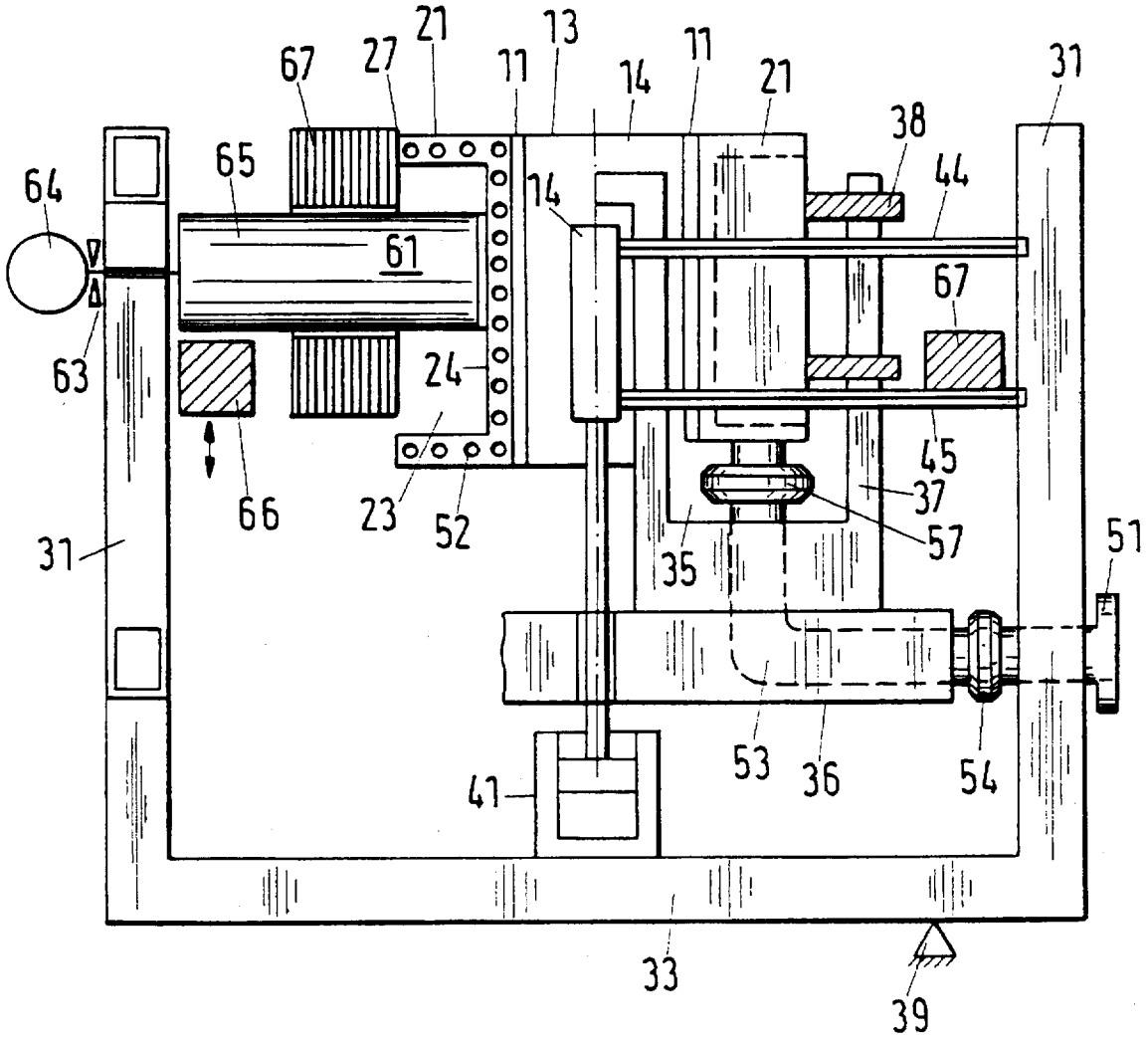
FIG. 1 is a section through the mold arrangement pursuant to the present invention, along the line A–B in FIG. 2.
Figure 2:
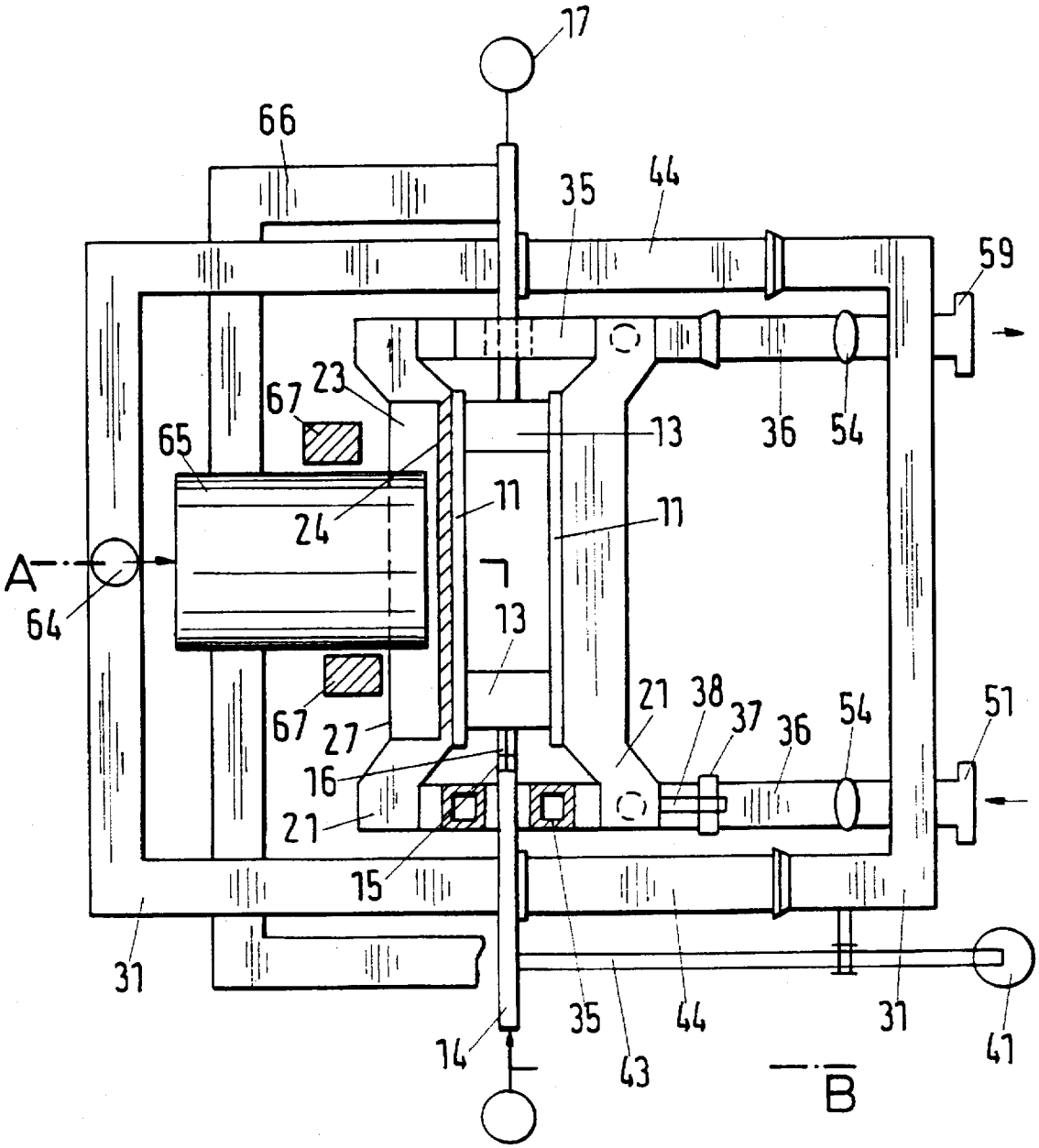
FIG. 2 is a top view of the mold arrangement.

FIG. 1 is a section through the inventive mold arrangement, namely along the line A–B of FIG. 2. In the right-hand part of the figure there is shown a mounting frame with a longitudinal part 31 and a holding part 33 that is transverse thereto. The holding frame 31, 33 rests on a foundation 39.

On the longitudinal part 31 of the holding frame upper spring elements 44 and lower spring elements 45 are fastened at one of their ends. A narrow-side holder 14 is arranged on the other end of the spring elements 44, 45. This drive-side narrow-side holder 14 is connected to an oscillator 41 which, in its turn, rests on the traverse part 33 of the holding frame which rests on the foundation 39.

The narrow-side holder 14 is connected—not further shown here—to a narrow-side 13 of the mold. The narrow side 13 is clamped between the wide sides 11 of the mold and the wide sides 11 are fastened on support plates 21.

Furthermore, in the right-hand part of FIG. 1, a water inlet 51 is provided in the longitudinal mounting frame part 31. The water inlet 51 is in communication, via an elastic element 54, with a water feed 53 which is introduced into a mounting-yoke support member 36. The elastic element 54 is designed to take up the oscillatory movement of the mold and guide the coolant dependably.

On the mounting yoke support member 36 there rests, in the region of the water feed 53, a mounting yoke 35 which is connected via a flexible element 57 with the support plate 21. The mounting yoke 35 is fork-shaped in its central region and surrounds the narrow-side holder 14. The two-armed mounting yoke 35 has, at both ends, arms 37 on which wide-side holders 38 are provided, by which the support plates 21 are adjustable relative to each other according to the width of the casting.

The left-hand half of FIG. 1 shows a section through the support plate 21. From this view cooling channels 52 in the support plate 21 can be noted.

The support plate 21 is trough shaped and the wide side 11 is fastened to the outside thereof. The opening of the trough faces away from the wide sides 11, and a coil core 65 of an agitator coil 61 extends into the free space 23 of the trough and rests against the bottom 24 of the trough. The coil core 65 is surrounded by an axially displaceable coil 67 which can be brought into the vicinity of an outer wall 27 of the support plate 21. Other electromagnetic structural pans can also be used, such as an electromagnetic brake.

The coil core 65 rests on a coil yoke 66 which is formed as a ring. The coil yoke 66 is adjustable in height.

The coil core 65 is connected to a drive 64 attached to the mounting frame and can be displaced horizontally by the drive 64 to such an extent that it can be pulled, at its head end, out of the trough free space 23 of the support plate 21. A clamp 63 is provided to fix the coil core 65 in its position.

FIG. 2 is a top view of the mold arrangement. In the center of FIG. 2 there can be noted the support plates 21 provided with the wide sides 11, between which the narrow sides 13 are clamped.

The narrow sides 13 are connected to the mounting frame via a further narrow-side holder 16, gripping elements 15 and the narrow-side holders 14, to which spring elements 44 are attached.

Furthermore, a transmission drive 43 is rotatably mounted on the mounting frame 31. One arm of the transmission drive 43 is connected to an oscillating device 41 and the other arm is connected to the narrow-side holder 14. The narrow-side holder 14 is furthermore coupled with a narrow-side drive 17.

In the right-hand part of FIG. 2, the mounting-yoke support members 36 are shown which are connected, via the elastic elements 54, with the coolant water inlet 51 and a coolant water discharge 59.

The mounting yoke 35 rests on the mounting-yoke support 36. The mounting yoke 35 has arms 37 which are fastened to the support plates 21 by the wide-side holders 38.

In the lower part of FIG. 2, there is shown a section through the fork-shaped part of the mounting yoke 35 through which the narrow-side holder 14 is guided. In the upper part of FIG. 2 there is a top view of the forked-shaped part of the mounting yoke 35.

The left-hand part of FIG. 2 shows a partial section through the support plate 21. In the trough free space 23 the coil core 65 has been introduced with its head end up against the base of the trough 24. The coil core 65 is surrounded by the coil 67. In the lower region of the left-hand part of FIG. 2, the coil 67 is close to the outer wall 27 of the support plate 21.

The coil core 65 rests on the coil yoke 66 which surrounds the support plates 21 annularly.

Figure 3:
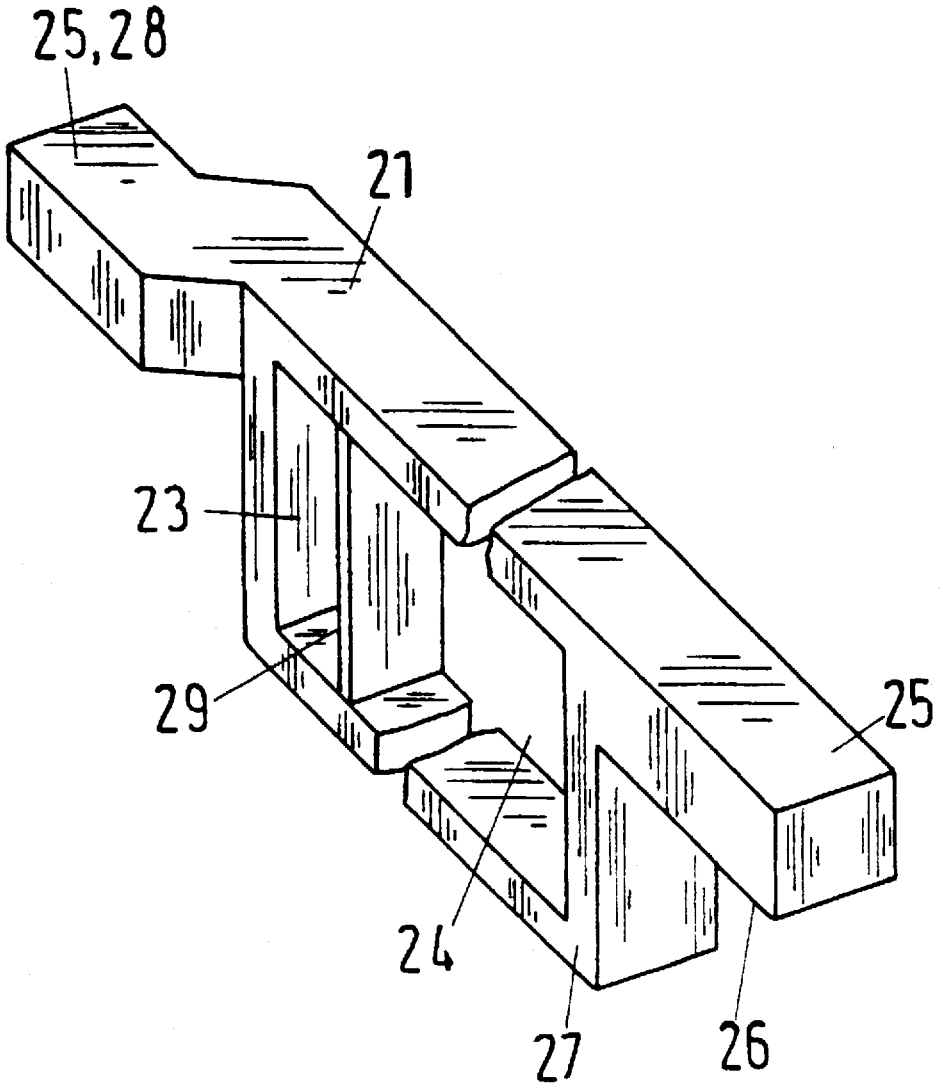
FIG. 3 is a perspective view of a support plate.

FIG. 3 shows, in perspective, the support plate 21 with the trough space 23 and the trough base 24. On the support plate 21, projections 25, 28 are arranged at both ends, the projection 28 in the upper part of the figure being offset. Due to this construction, a particularly large space is obtained for installing of the mounting yoke and the narrow-side holder. The projections 25, 28 have resting surfaces 26.

In the upper part of the sketch, a partition wall, a rib or a web 29 is arranged in the trough free space 23 of the support plate 21.

Figure 4:
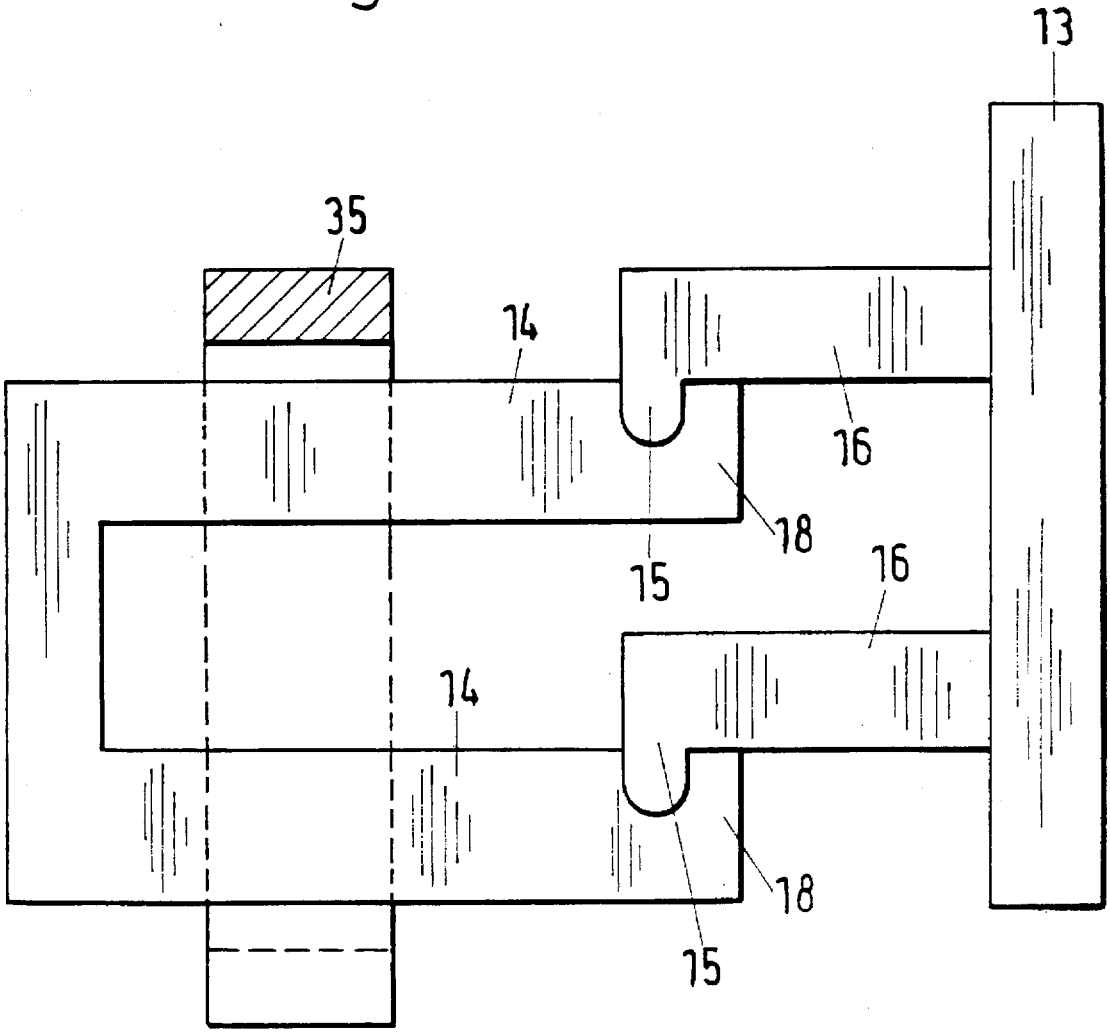
FIG. 4 is a sketch of the wide-side mounting.

FIG. 4 diagrammatically shows a narrow-side 13, on which there is arranged the further narrow-side holder 16 which has the gripping elements 15 on its head end. These gripping elements 15 correspond to shaped elements 18 in the narrow-side holder 14. The narrow-side holders 14 are conducted through an opening in the fork-shaped mounting yoke 35.

As shown in FIG. 1, the mounting yoke 35 is connected to the support plates 21 which hold the narrow sides 13.

The upper holder has an anti-lift-off lock (not shown here) which, in operation, prevents the narrow-side holder 14 from slipping out in upward direction and permits, after manual loosening, a lifting off essentially of the support plates 21, including the mounting yoke 35.

The invention is not limited by the embodiments described above which are presented as examples only but can be modified in various ways within the scope of protection defined by the appended patent claims.

I claim:

1. A mold arrangement for producing an endless metal casting, comprising:

a mold having opposing wide sides made of copper plates and narrow sides arranged between the wide sides;

support plates, each of the wide sides being arranged to rest against a respective one of the support plates, the support plates being configured to have wall which define a trough-shape in a region of the wide sides of the mold;

means for oscillating the support plates;

coolant channels provided in the walls of the trough-shape support plates so as to facilitate passage of a coolant;

agitator coils, each of the coils having a core and a coil which loosely surrounds the core and is displaceable axially to the core:

a frame on which the agitator coils are mounted so as to be freely introducible into free spaces formed by the trough-shape support plates; and drive means for moving the agitator coils at right angles to a direction of casting, the drive means being mounted on the mounting frames, the support plates each having an outer wall, the cores being arranged to be close to a base of the trough-shaped free space and the respective coil being positionable on the outer wall of the support plate.

2. A mold arrangement according to claim 1, and further comprising means provided on the mounting frames for fixing the agitator coils in position.

3. A mold arrangement according to claim 1, wherein the respective core of the agitator coils are arranged in the trough space to be adjustable relative to a casting direction.

4. A mold arrangement according to claim 3, wherein the drive means is operative to adjust the cores of the agitator coils relative to the casting direction.

5. A mold arrangement according to claim 1, wherein the agitator coils are electromagnetic brakes.

6. A mold arrangement according to claim 1, wherein the trough-shaped support plates have a projection on each end, each projection having a bottom surface configured as a resting surface.

7. A mold arrangement according to claim 6, and further comprising two-armed mounting yokes arranged at right angles to the support plates, the support plates being arranged so that the resting surface of the projections rests on the two-armed mounting yokes.

8. A mold arrangement according to claim 7, and further comprising holder means for holding the narrow side of the mold, wherein the mounting yoke is configured to have a fork shaped central region and to surround the narrow-side holder means from above.

9. A mold arrangement according to claim 8, wherein the mounting yoke has a water feed passage in a region adjoining the fork-shaped region.

10. A mold arrangement according to claim 9, and further comprising flexible elements arranged between the projections of the support plates and the water feed passage of the mounting yoke.

11. A mold arrangement according to claim 1, and further comprising a web arranged in the trough free space of the support plates.

12. A mold arrangement according to claim 8, wherein the narrow-side holder means includes a mold-side narrow-side holder part, a gripping element connected to the mold-side narrow-side holder part in a form-locked manner, and a drive-side narrow-side holder part connected at one end to the gripping element.

* * * * *